United States Patent [19]

Bozek

[11] Patent Number: 4,651,707

[45] Date of Patent: Mar. 24, 1987

[54] MECHANICAL PROJECTOR WITH VARIABLE LEVERAGE ARRANGEMENT

[76] Inventor: John W. Bozek, 6093 Waterfront Dr., Waterford, Mich. 48095

[21] Appl. No.: 880,303

[22] Filed: Jun. 30, 1986

[51] Int. Cl.[4] ..... F41B 3/00

[52] U.S. Cl. ..... 124/17; 124/20 R; 124/23 R

[58] Field of Search ..... 124/17, 16, 23, 24, 124/20, 25

[56] References Cited

U.S. PATENT DOCUMENTS

| | | | |
|---|---|---|---|
| 2,430,685 | 11/1947 | Pearson | 124/20 X |
| 3,028,851 | 4/1962 | Drake | 124/25 X |
| 3,552,373 | 1/1971 | Van Hecke | 124/17 X |
| 3,851,638 | 12/1974 | Alexander | 124/24 R |
| 4,041,927 | 8/1977 | Van House | 124/24 R X |
| 4,169,453 | 10/1979 | Hunsicker | 124/20 R |
| 4,201,182 | 5/1980 | Butler | 124/24 R |
| 4,227,509 | 10/1980 | Jones | 124/23 R |
| 4,338,909 | 7/1982 | Plummer | 124/16 |
| 4,411,248 | 10/1983 | Kivenson | 124/20 R |
| 4,458,657 | 7/1984 | Stockmar | 124/17 |

*Primary Examiner*—Paul E. Shapiro

*Attorney, Agent, or Firm*—John R. Benefiel

[57] ABSTRACT

A slingshot is disclosed in which pairs of primary and secondary swing arms pivoted to a holder frame are pivoted by drawing of a connected drawstring against the resistance of elastic elements, and in which the secondary swing arms swing out to provide a relatively great payout of the drawstring as it is moved to the fully drawn position. This allows the use of an inelastic drawstring.

8 Claims, 8 Drawing Figures

MECHANICAL PROJECTOR WITH VARIABLE LEVERAGE ARRANGEMENT

FIELD OF THE INVENTION

This invention concerns mechanical projectors of the type including a pair of swingable arms attached to the ends of a drawstring which is drawn to swing the arms from a rest position against the resistance of elastic elements. The release of the drawstring causes launching of a projectile carried by the drawstring as the arms snap back to their rest position.

BACKGROUND

Mechanical projectors broadly comprise devices having one or more movable launching members, which are moved as by pulling of a drawstring from a rest position to an advanced firing position against the resistance of one or more elastic elements, so that upon release, a projectile is rapidly accelerated so as to be launched by the return motion of the launching member. Such projectors include archery bows, cross bows, slingshots, and spring guns. In an archery bow, the limbs of the bow comprise the elastic elements resisting the drawing of the drawstring, while in a sling shots, this element is usually comprised of a stretchable strip, itself also comprising the launching element.

In most of these devices, except for the mechanically triggered crossbows, the exertion required by the user typically is at a maximum in the fully drawn aiming position, so that accuracy is adversely affected and for high powered devices, it is difficult to hold the drawstring in the firing position for any length of time.

There has thus heretofore been developed variable leverage devices particularly for archery bows in which the drawstring acts to bend the limbs through eccentric reels so that as the drawstring reaches the full draw position, the effort required falls off to make aiming steadier as a result of the greatly reduced effort required to hold a full draw. See U.S. Pat. No. 3,486,495 to Allen for an example as such an arrangement. Such bows have thus met with great success.

An advantage of the "Allen" bows is that the wind up and pay out of the drawstring on and off the reels allows the use of shorter and stiffer bow members, since the extension of the drawstring necessary to allow a full draw is made up only partly by the bending of the limb tips, the remainder by pay out of the reels. The drawstring payout is limited in the eccentric reel Allen bows by the diameter of these reels, and to greatly shorten the bow member would require excessively large reels.

It would be desirable to apply such variable leverage effect to other mechanical projectors, such as sling shots, but the absence of yielding limbs in a slingshot this would require overly large reels to establish sufficient drawstring payout to accommodate the drawing motion.

Accordingly, it is an object of the present invention to provide a variable leverage arrangement for mechanical projector in which the drawing motion is achieved substantially entirely from the payout of drawstring from the variable leverage device.

It is another object of the present invention to provide a variable leverage device for a sling shot type mechanical projector in which the launching element may be relatively unyielding, and in which separate elastic elements are incorporated to provide the projectile accelerating forces.

SUMMARY OF THE INVENTION

These and other objects of the present invention which will be understood upon a reading of the present application, are provided by a projector device comprised of primary swing arms pivotally mounted at one end to a holder member to be swingable thereon from an initial to an advanced position. Swinging movement from the initial position is accomplished by drawing motion of a relatively unyielding drawstring, which motion is resisted by elastic elements connected at an intermediate point to each of the primary swing arms to generate energy for launching of a projectile by release of the drawstring.

A secondary swing arm is pivotally connected to the distal ends of each primary swing arm and the drawstring is connected at either end to the distal ends of the respective secondary swing arms.

Pivoting of the secondary swing arms is constrained in relation to the swinging of the primary swing arms so that the secondary swing arms are allowed to swing away from the distal ends of the primary swing arms only after the primary swing arms have swung from their initial positions to approach the advanced draw position. This allows an increasing leverage to be exerted by the drawstring acting to overcome the resistance of the elastic elements by drawing motion of the drawstring, to allow a reduced effort at full draw.

Elastic bands are utilized as the resilient elements in the sling shot embodiment disclosed.

A constraining cable is connected to each secondary swing arm at an intermediate point and to a fixed point on the holder member, and located to control the swing motion of the connected secondary swing arm in correspondence to the swinging of the connected primary swing arm, so as to be swung outwardly only upon moving towards the draw position thereof.

In the preferred embodiment, the primary swing arms are swept forwardly in the initial position, with the secondary swing arms folded ahead of a respective primary swing arm, the drawstring pssing around guides located at the distal ends of each primary swing arm and thence to be connected to the distal end of each secondary swing arm.

A gear train is driven by swinging of the primary swing arms to insure perfectly coordinated of the primary swing arms.

DETAILED DESCRIPTION

Figure 1:
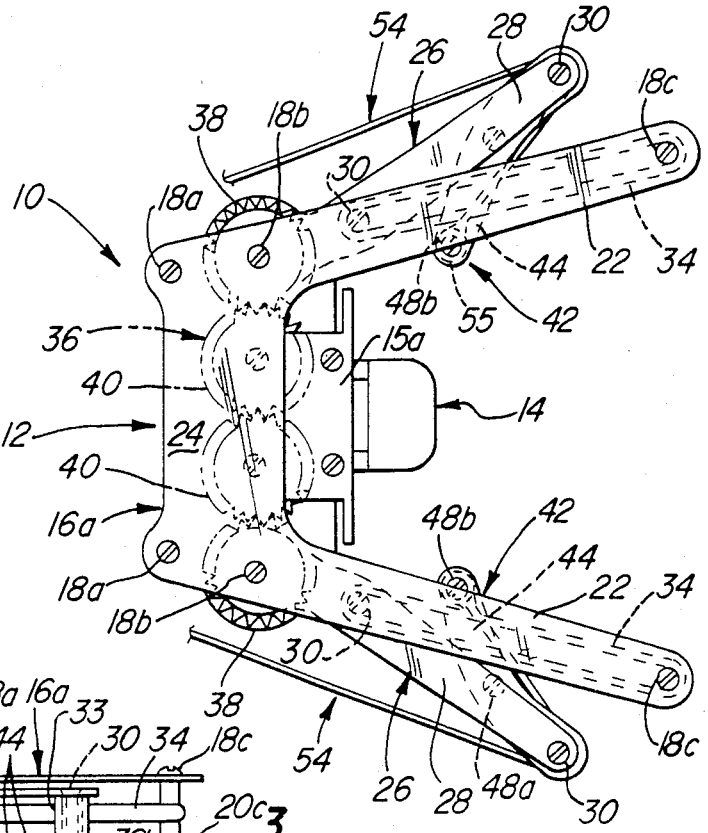
FIG. 1 is a plane view of a slingshot according to the present invention.
Figure 2:
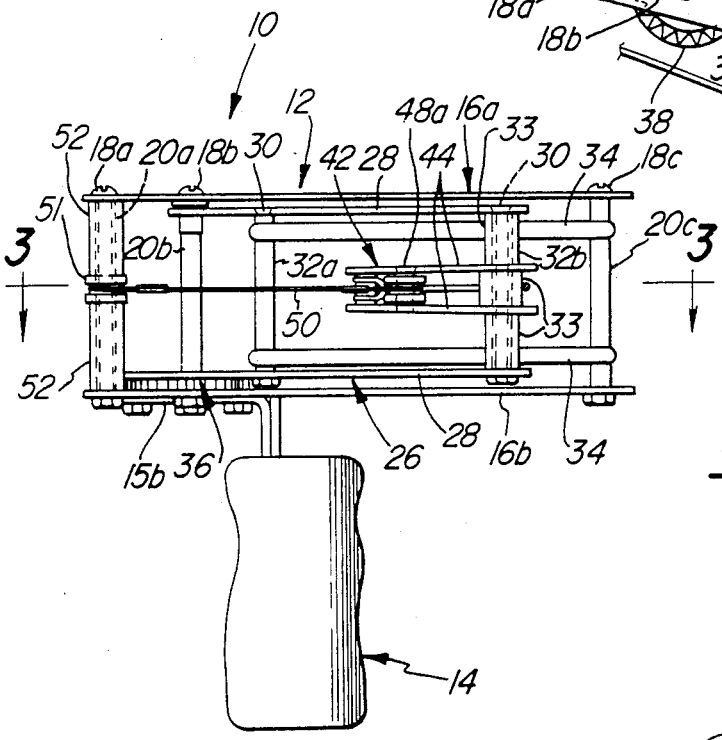
FIG. 2 is a side elevational view of the sling shot shown in FIG. 1.
Figure 3:
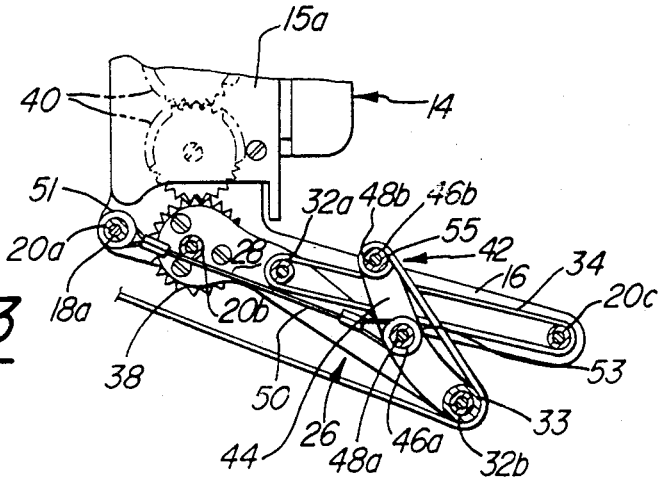
FIG. 3 is a view of the section 3—3 taken in FIG. 2.

In the following detailed description, certain specific terminology will be employed, and a particular embodiment described in accordance with the requirements of 35 USC 112, but the invention is not so limited and indeed should not be so construed, as the invention is capable of taking many forms and variations within the scope of the appended claims.

Referring to the drawings, the mechanical projector according to the embodiment shown comprises a slingshot 10, having a central holder frame 12, with a handle 14 affixed thereto by screws passing through upper and lower flanges 15*a*, 15*b*, the handle 14 adapted to be grasped in one hand of the user.

The holder frame 12 includes a pair of spaced apart generally U-shaped upper and lower holder frame plates 16*a*, 16*b*, connected together by screws 18*a*, 18*b*, 18*c*, each passing respectively through one of sets of tubular posts 20*a*, 20*b*, 20*c* on either side of the holder frame 12.

Each holder frame plates 16*a*, 16*b*, includes a pair of elongated rear projecting portions 22 joined by a central portion 24.

A primary swing arm 26 is pivotally mounted at one end to the holder frame 12 on either side thereof, each primary swing arm comprised of pairs of elongated, slightly angled plates 28 connected by screws 30 passing through posts 32*a* and 32*b*.

Each of the primary swing arms 26 is biased an initial position in which it is sharply angled forwardly by a pair of elastic bands 34 received around post 20*c*, located at the ends of plates 16 and around post 32*a* located at a point intermediate the length of primary swing arm 26.

Elastic bands 34 act as spring means resisting swinging movement of the primary swing arms 26 from their initial positions, so as to create stored energy for release at firing as will be described.

Synchronizing means are provided to insure coordinated movement of the primary swing arms 26 with each other, taking the form of a gear train 36 operated by swing motion and drivingly interengaging each of the primary swing arms 26.

Gear train 36 includes gears 38 affixed to the pivoted end of each lower plate 28 of each swing arm 26, and reversing idler gears 40 rotatably mounted above the lower holder plate 16*b*, and below upper flange 15*a* of handle 14. Thus, as either primary swing arm 26 rotates, the other must also rotate exactly equally and oppositely to thereby insure perfectly coordinated movement, important to the functioning and accuracy of the device, as will be appreciated by those skilled in the art.

Pivotally mounted to the distal end of each primary swing arm 26 is a secondary swing arm 42, received on post 32*b* with spacers 33 locating the same axially thereon. Each secondary swing arm 42 also consists of pairs of elongated slightly angled plates 44 affixed together with posts 46*a*, 46*b*, and screws 48*a*, and 48*b* respectively.

The motion of each of the secondary swing arms 42 are constrained by means of cables 50 each looped at one end over a grooved bushing 51 and received over post 20*a* and between spacers 52 and each other end looped over a grooved bushing 53 received over post 46*a* located at a point intermediate the length of the secondary swing arms 42.

This constraint controls the swinging of the secondary swing arms 42 on the distal ends of the primary swing arms 26 so that movement of the secondary swing arms 42 swinging away therefrom only occur as the primary swing arms 26 move from their initial positions and in correspondence therewith.

Figure 4:
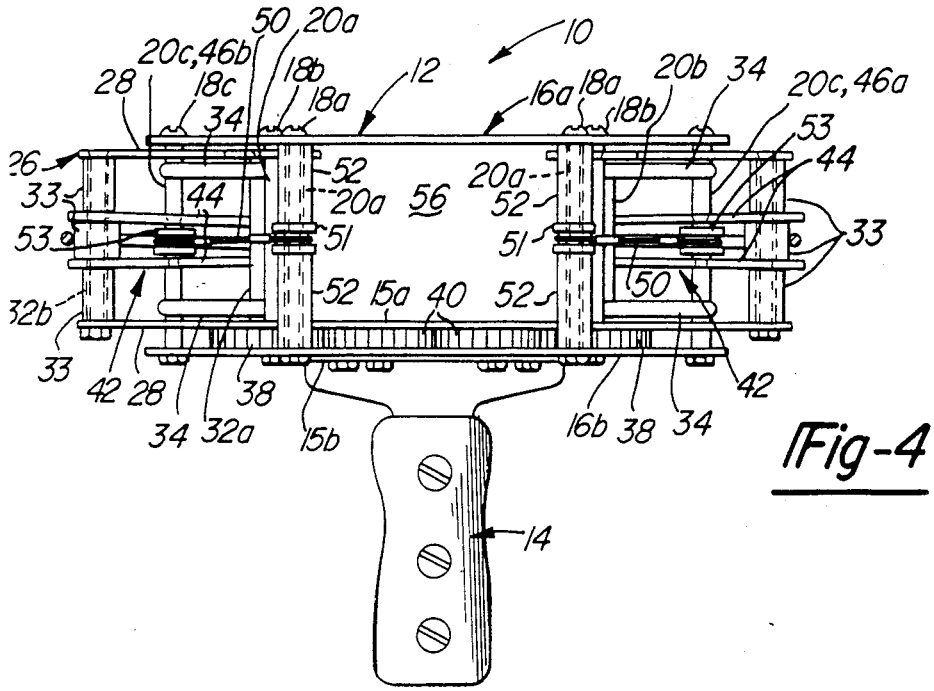
FIG. 4 is a front elevational view of the sling shot shown in FIGS. 1 and 2.

A drawstring 54 has each end 55 looped around the post 32*b* at the distal end of each secondary swing arm 42. The drawstring 54 is provided with a conventional pouch (not shown) adapted to receive a projectile and accelerate and launch the same through clearance opening 56 (FIG. 4) at firing by release of the fully drawn drawstring 54. Thus, the drawing motion of drawstring 54 exerts a force tending to swing the primary swing arms 26 about pivots defined by posts 20*b* against the resistance of elastic bands 34.

The initial position of the primary swing arms 26, is sharply angled forwardly, and the initial corresponding position of the secondary swing arms 42 is folded ahead of the primary swing arms 26. Thus the drawstring 54 passes around spacers 33 in extending to the distal ends of the secondary swing arms 26.

Figure 5A:
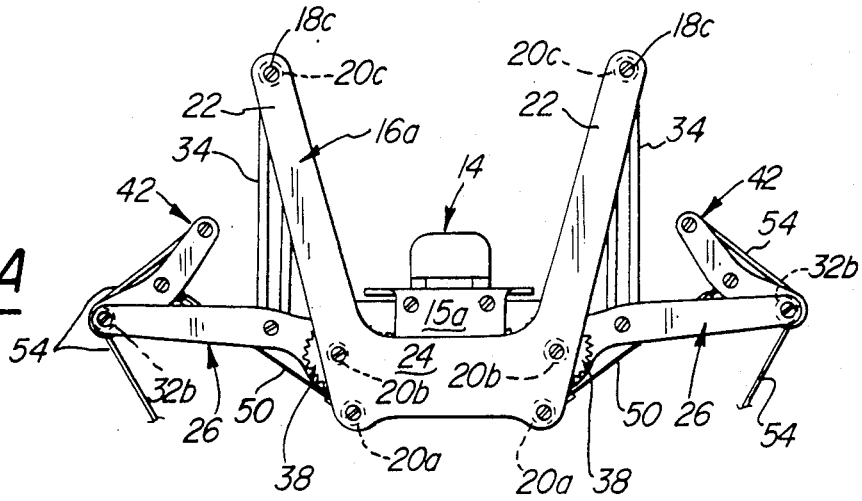
FIGS. 5 A–D are successive plan views of the motion of a connected primary and secondary swing arms as the drawstring is moved from the initial position shown in FIG. 1 to the fully drawn position shown in FIG. 5D.

As seen in FIG. 5A, the primary swing arms 26 initially swings out, stretching band 34 while secondary swing arm 42 remains folded ahead thereof although moved away slightly.

Figure 5B:
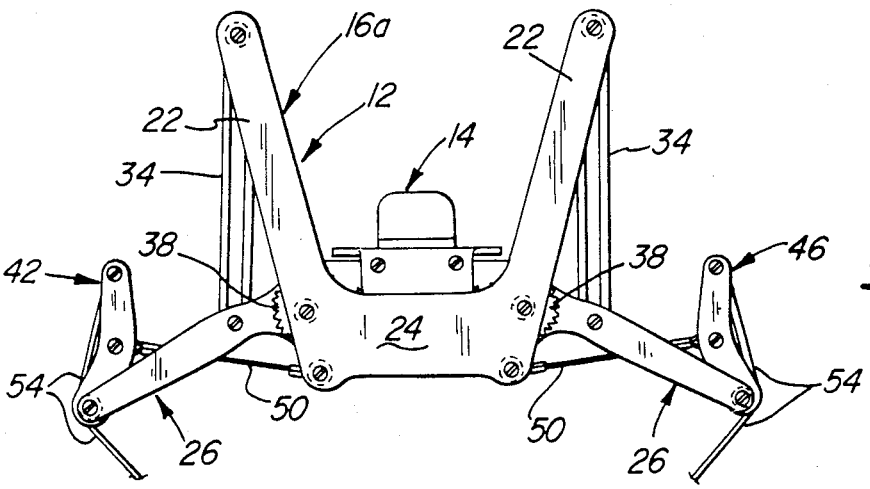

In FIG. 5B, the primary swing arm 26 is now slightly angled rearwardly, and the secondary swing arm 42 is moving away but still not outward of the distal end of the primary swing arm 26.

Figure 5C:
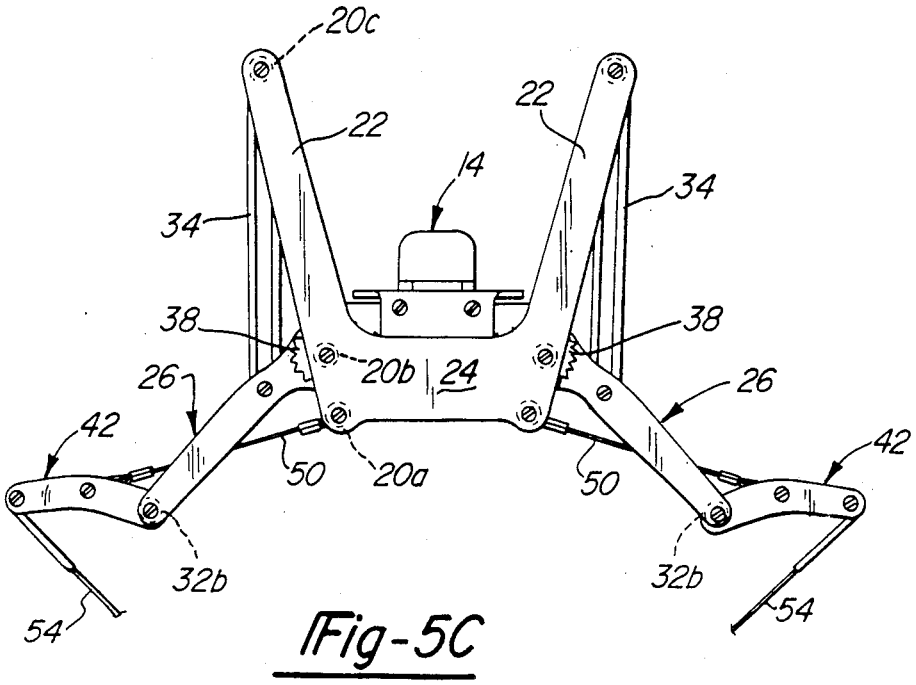

As the draw progresses to an advanced position, as shown in FIG. 5C, the length of the cable 50 and the changing relative location of the post 20*a* now allows the secondary swing arm 42 to rapidly swing out from the distal end of primary swing arm 26.

Figure 5D:
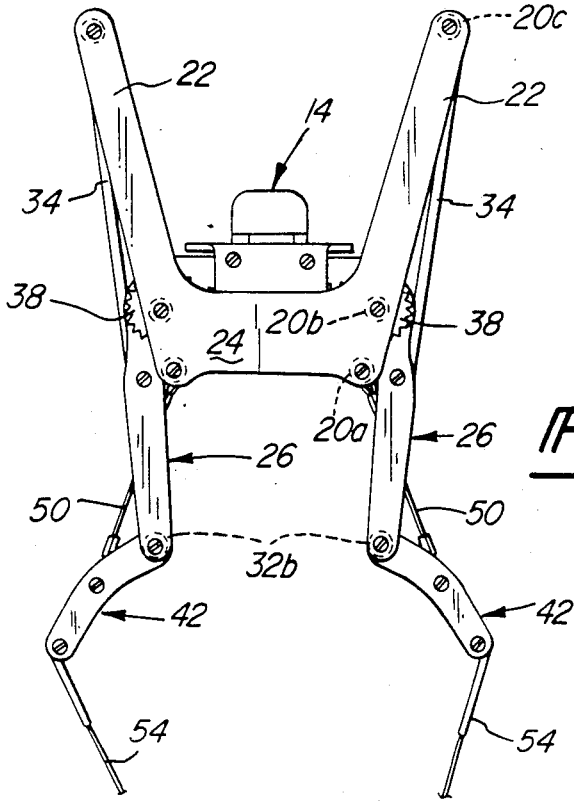

The swing out of the secondary swing arms 26 affords a dramatically increased leverage able to be exerted by the drawstring 54 in overcoming the resistance of the elastic bands 34, since the effective lever arm about its pivot, comprised a post 20 (b), is greatly increased as the secondary swing arms move to their fully extended position shown in FIG. 5D.

It can be seen that the primary swing arms 26 rotates so that point of connection of the elastic bands 34 move towards being aligned with pivot points of the primary swing arms 26, so that the lever arms acted on by the elastic bands 34 becomes greatly reduced at full draw so that the force required to hold the drawstring 54 at full draw remains greatly reduced even though the lever arm acted on by the drawstring is shortened somewhat at full draw.

I claim:

1. A mechanical projector with a variable leverage arrangement comprising:

a central holder member;

a pair of primary swing arms mounted on said central holder member to be swingable on either side of said holder member;

spring means acting on each of said primary swing arms at an intermediate point along the length thereof resisting swinging on said holder member from an initial position, and acting on said primary swing arms when released to restore said primary swing arms to said initial position;

a pair of secondary swing arms, each pivoted at one end to the distal end of a respective primary swing arm;

constraining means acting on each of said secondary swing arms constraining the pivotal movement of each of said secondary swing arms to correspond to swinging movement of a respective primary swing arm, as each of said primary swing arms swing away from said initial position of said primary swing arm, from an initial pivotal position of each of said secondary swing arms to an advanced position swung away from said distal end of said respective primary swing arm;

a drawstring connected at either end to the distal end of each secondary swing arm, whereby drawing of said drawstring acts through each of said secondary swing arms to cause pivoting of each of said primary swing arms away from said initial positions thereof against the resistance of said spring means, with increasing leverage exerted thereby as said distal ends of said secondary swing arms pivot away from said distal ends of said primary swing arms.

2. The projector according to claim 1 wherein said constraining means comprises a pair of cables each connected at one end to a respective secondary swing arm at a point intermediate the length thereof, and at the other end to a point on said holder member allowing said pivoting of said distal end of said primary swing arm away from said distal end of each respective primary swing arm as each of said primary swing arms pivot away from said initial position thereof.

3. The projector according to claim 1 wherein each of said primary swing arms are inclined away from the direction of pull of said drawstring in said initial position and each of said secondary swing arms are folded ahead of a respective primary swing arm in its initial position, and further including guide means located at the distal end of each primary swing arm allowing said drawstring to be passed therearound to the point of connection to each distal end of said secondary swing arms.

4. The projector according to claim 1 further including means causing coordinated pivoting motion of each primary swing arm with respect to each other.

5. The projector according to claim 4 wherein said means includes a gear train drivingly each primary swing arm and driven by pivoting movement thereof.

6. The projector according to claim 1 wherein said spring means includes a pair of elongated elastic elements each connected at one end to said holder member, and at the other end to a respective primary swing arm so as to be stretched upon pivoting movement of said respective primary swing arm away from said initial position.

7. The projector according to claim 6 wherein said points of connection of each of said elastic elements moves towards the points of pivotal connection of said primary swing arms to said holder member as said secondary swing arms swing away from said distal ends of said primary swing arms.

8. The projector according to claim 6 further including a central handle fixed to said central holder member, and a space located between said pairs of primary and secondary swing arms in the plane of said drawn drawstring, allowing a projectile to be projected through said space by release of said drawn drawstring and returning of said swing arms to their respective initial positions.

* * * * *